United States Patent [19]

Wiethoff

[11] 3,955,301

[45] May 11, 1976

[54] QUICK-LOAD HANDGUN

[75] Inventor: Günter Wiethoff, Solingen, Germany

[73] Assignee: Firma Cuno Melcher KG ME-Sportwaffen, Solingen, Germany

[22] Filed: Mar. 29, 1974

[21] Appl. No.: 456,253

[30] Foreign Application Priority Data

Mar. 30, 1973 Germany ..... 7312072

[52] U.S. Cl. ..... 42/59; 42/89

[51] Int. Cl.[2] ..... F41C 1/00; F42B 39/04

[58] Field of Search ..... 42/59, 62, 77, 89

[56] References Cited

UNITED STATES PATENTS

| | | | |
|---|---|---|---|
| 2,113,822 | 4/1938 | Barros | 42/89 |
| 2,150,914 | 3/1939 | Gaidos | 42/59 |
| 2,215,726 | 9/1940 | Masterton-Smith | 42/89 |
| 2,329,273 | 9/1943 | Kelly | 42/62 |
| 2,976,638 | 3/1961 | Owens | 42/59 |

*Primary Examiner*—Charles T. Jordan
*Attorney, Agent, or Firm*—Karl F. Ross; Herbert Dubno

[57] ABSTRACT

A revolver-type pistol has a cylinder formed of a front section rotatably mounted on the pistol frame and a removable rear section formed with a plurality of throughgoing chambers each adapted to receive a respective cartridge. This rear section can be removed from the front section with the spent cartridges and replaced by another section so as to allow quick reloading of the pistol. A coupling is provided between the two sections to rotationally link them together and a spring-loaded mechanism is provided to hold the rear section tightly against the front section. The chambers in the rear section may terminate at the front face of the rear section in small holes alignable with similar holes in the front section so that the blank cartridges exploded in the rear section will discharge through these holes. The front section may have a rearwardly extending stem formed with teeth operated by the mechanism of the pistol to rotate the cylinder. The rear section in this case is of annular shape and carried on this rearwardly extending stem.

5 Claims, 10 Drawing Figures

QUICK-LOAD HANDGUN

FIELD OF THE INVENTION

The present invention relates to a handgun. More particularly this invention concerns a cylinder for a revolver-type starter pistol or the like.

BACKGROUND OF THE INVENTION

A handgun of the revolver type generally has a pistol frame in which a cylinder is rotatable. A plurality of bores or chambers formed in the cylinder are alignable between a hammer at the rear of the gun and a barrel at the front so this hammer may fire the cartridge in the chamber and expel the bullet through the barrel. Mechanism is provided connected between the hammer and a trigger which operates the hammer to rotate the cylinder through a predetermined angular distance each time it is fired so that a fresh cartridge is aligned between the hammer and barrel. This mechanism generally engages the rear end of the cylinder.

Such a revolver is reloaded usually by swinging the cylinder out of the frame. The spent cartridges can then either be removed one by one, or a release carried on the pistol can be pressed to push them all out of their chambers. Thereafter fresh cartridges are loaded one by one into the empty chamber, the cylinder is snapped back in place, and the handgun can again be fired.

Such an operation is relatively time-consuming. When the handgun is being used as a weapon or in competition it is frequently highly disadvantageous to spend a relatively long period of time reloading. Even when the handgun is a simple starter or signal pistol it is often very bothersome to have to painstakingly reload. This time-consuming loading operation is additionally disadvantageous when it must be done out of doors, where the pistol must be held open frequently in wet or otherwise potentially damaging surroundings.

OBJECTS OF THE INVENTION

It is therefore an object of the present invention to provide an improved handgun.

Another object of this invention is the provision of a revolver-type handgun having a cylinder which allows rapid and easy reloading.

A further object is to provide a starter or signal revolver which is readily reloaded and safe in use.

Another object is to provide a so-called blank pistol, that is a pistol not capable of shooting regular ammunition, which has the outward appearance of a conventional revolver.

SUMMARY OF THE INVENTION

These objects are attained according to the present invention in a revolver-type pistol having a chambered cylinder formed of two independent and separable sections. The front section is rotationally carried on the revolver and forms a plurality of throughgoing holes alignable with the barrel. The rear section is removable and is formed with a plurality of throughgoing chambers alignable with the bores in the front section and each adapted to receive a respective cartridge. Means is provided for rotationally coupling the sections together and for holding the rear section in place on the front section. The two sections according to this invention form a cylinder of conventional appearance.

The pistol according to the present invention can be reloaded in an instant. The user need merely swing the two-part cylinder out of the frame, pull off the rear section and replace it with another rear section whose chambers are filled with fresh cartridges. This entire operation takes very little time and can be carried out with such ease that the pistol can be reloaded readily even in the dark.

According to yet another feature of this invention the chambers in the rear section are narrowed at the front face of this rear section and the bores formed in the front section are of small diameter, corresponding to the small-diameter openings formed at the front of each of the chambers. Such a pistol is used as a blank pistol and the blast of air generated by the blank is funneled out of the barrel safely away from the user. At the same time this blank pistol has all of the appearance of a conventional revolver since the two sections of the cylinder fit snugly together, presenting the appearance of a regular shootable handgun.

In accordance with yet another feature of this invention the front section has a backwardly extending stem which is engaged by the mechanism of the handgun and serves for rotation of the two cylinder sections each time the pistol is fired. The rear section is a steel ring which fits over this stem.

It is also within the scope of this invention to provide a rear section having formations engageable with the mechanism in the pistol so that when a fresh cartridge is to be brought under the hammer this rear section entrains the front section rotationally.

According to yet another feature of this invention the means rotationally coupling the two sections together is an axially extending pin formed on one of the sections and received in a correspondingly shaped recess of the other section. The means securing the rear section snugly in place on the front section comprises a spring-biased ball carried in a bore on the rear section and radially engageable with the above-mentioned rearwardly extending pin on the front section.

BRIEF DESCRIPTION OF THE DRAWING

The above objects, features, and advantages will become more readily apparent from the following, reference being made to the following drawing in which.

SPECIFIC DESCRIPTION

Figure 1:
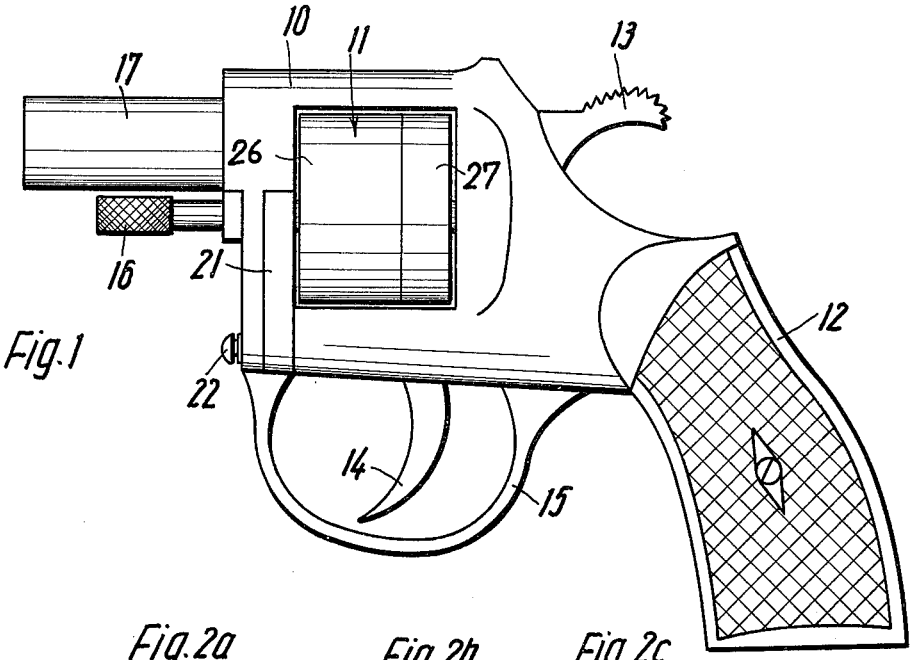
FIG. 1 is a side view of a handgun according to the present invention.

As is shown in FIG. 1 a handgun has a frame 10 carrying a barrel 17 at its front end and a grip 12 at its rear end. A cylinder 11 rotatable about an axis pin 16 is held in the frame 10 between a hammer 13 thereon and a barrel 17. This cylinder 11 is rotationally mounted at its front end on an arm 21 which can swing about an axis 22 so as to allow this cylinder to be swung out of the frame 10. A trigger 14 within a trigger guard 15 serves to release the hammer 13 and discharge cartridges within the cylinder 11.

As shown in FIGS. 2*a* – 2*d* and FIGS. 3*a* and 3*b* the cylinder 11 comprises a relatively long front section 26 and a relatively short rear section or clip 27 separated from the front section 26 at a parting line 18.

The front section 26 is of generally cylindrical shape and is formed with six angularly equispaced longitudinally extending grooves 23. Underneath each groove 23 is a respective small-diameter bore 20 which is directly alignable with the barrel 17. In addition the cylinder section 26 is formed with a rearwardly extending stem 25 centered on its rotation axis and formed adjacent its rear surface 36 with a short cylindrical portion 34. The stem 25 is formed with a forwardly tapered frustoconical region 29 defining a notch 38 with the cylindrical portion 34. Six teeth 39 are formed at the rear face of the stem 25 and cooperate with a mechanism inside the revolver frame 10 that serves to rotate the cylinder each time the hammer 13 is cocked.

The rear section 27 of the cylinder 11 is also made of steel and is of generally cylindrical shape. This section 27 is formed with a plurality of narrow radially equispaced grooves 23' which are alignable with the grooves 23 of the front section 26. In addition this section 27 is formed with six angularly equispaced chambers 19 each opening at the front face 35 of the section at a small hole 46 which is alignable with a respective bore 20 in the front section 26. The rear section 27 is angular and formed with a cylindrical central hole 28 which fits over the stem 25 snugly receiving the cylindrical section 34. The rear section 27 is formed with six relatively large-diameter holes 37 equispaced between the holes 46. The front section 26 is provided on its rear face 36 with an axially projecting pin 30 which is snugly engageable in any one of the holes 37. The holes 46 are smaller than the holes 37 so that the pin 30 cannot slip into one of these holes 46.

The rear section 37 is held on the stem 25 by means of a ball 33 received in a radial bore 41 formed in the ring 27. A spring 42 is braced between the ball 33 and a plug 43 so as to urge this ball inwardly. Thus when the ring 27 is slipped over the stem 25 the ball seats in the notch 38 and holds the two tightly together.

Figure 2A:
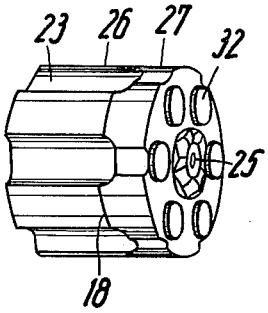
FIG. 2*a* is a side perspective view of the assembled cylinder of the handgun shown in FIG. 1.
Figure 2B:
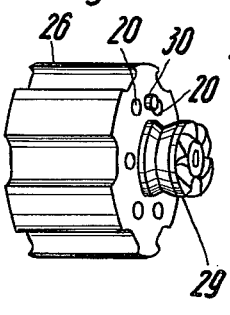
FIGS. 2*b*, 2*c*, and 2*d* are side perspective views respectively showing the front cylinder section, rear cylinder section, and cartridge holder according to the present invention.
Figure 2C:
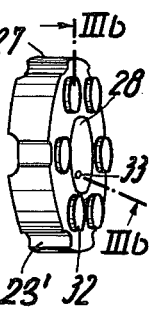

Blank cartridges 32 shown in FIG. 2*c* are receivable in the chambers 19. When struck by the hammer 13 they explode and send a jet of gases out the hole 46, through the bore 20 and out the barrel 17. Due to the tight fit at plane 18 between the two sections 26 and 27 there is virtually no flashing out the sides of the pistol which could injure the user.

Figure 2D:
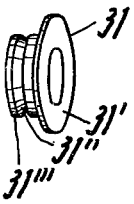

FIG. 2*d* shows a mushroom-shaped synthetic-resin holder 31 which has a disk top 31' adopted to overlie the top of the cartridges 32 and a stem 31''' formed with groove 31'' in which the ball 33 may engage. This element 31 is fitted to a loaded rear section 27 so it will hold the cartridges 32 tightly in place when the section 27 is not loaded into the handgun. As the thus equipped section 27 is pressed over the stem 25 this holder 31 is automatically pressed out of the bore 28.

Figure 3A:
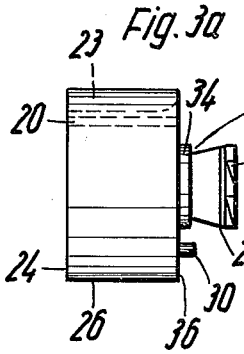
FIG. 3*a* is a side view of the front section of the cylinder.
Figure 3B:
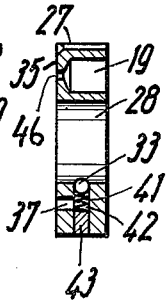
FIG. 3*b* is a section taken along line 3*b* — 3*b* of FIG. 2*c;*
Figure 3C:
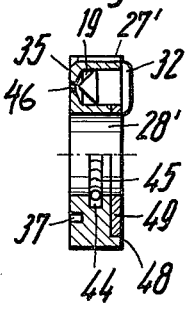
FIG. 3*c* is a section similar to FIG. 3*b* illustrating another structure in accordance with this invention.

FIG. 3*c* shows an arrangement identical to that described above except that the cartridges 32 are carried on a spider or ring 49 so that they can be loaded as a group into the chambers 19. In addition a groove 44 is formed inside the central bore 28' and a coil spring 45 in this groove 44 serves to hold the element 27' in place on the stem 25.

Figure 3D:
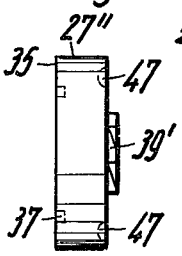
FIG. 3*d* is a side view of yet another configuration according to this invention.

In FIG. 3*d* the section 27'' is not annular but is formed at its rear face with teeth 39' which function as teeth 39 of the element 26. The recesses 47 in the back space of the element 27'' coact with mechanism inside the handgun and serve to rotate this element 27'' as well as a front element having no stem 25.

Figure 3E:
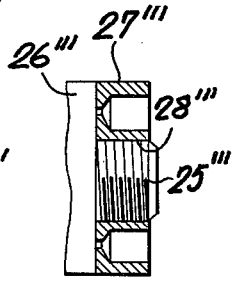
FIG. 3*e* is a side partly sectional view of a further cylinder in accordance with the present invention.

It is also within the scope of the invention as shown in FIG. 3*e* to thread a stem 25''' externally and thread bore 28'''' internally so as to be able to screw elements 26''' and 27''' tightly together.

The handgun is operated in the normal manner and, when the cartridges are all spent, the cylinder 11 is swung out on the arm 21. The rear section 27, 27', or 27'' is then pulled off the back of the front section 26 and a fresh fully loaded rear section is put in its place. This entire operation can be done in several seconds and can even readily be carried out in the dark.

I claim:

1. A rotatable cylinder for a revolver-type pistol having a barrel adjacent the front end of the cylinder, said cylinder comprising:

a front section formed with a plurality of throughgoing bores alignable on rotation of the cylinder with the barrel;

a rear section formed with a plurality of throughgoing chambers alignable with said bores and each adapted to receive a respective cartridge; and means for rotationally coupling said sections together and for holding said rear section releasably on said front section, said front section having a rearwardly extending stem and said rear section being a ring surrounding said stem, said ring being formed with a central cylindrical hole and said stem being at least partially cylindrical and snugly receivable within said hole, said stem having a rear face having formations for rotation of said cylinder, said front section having a rear face provided with a rearwardly extending pin constituting part of said means, said rear section having a front face formed with at least one recess adapted to receive said pin, said chambers being of smaller cross-sectional area toward said front end than toward said rear end, and said bores being of substantially the same cross-sectional area as said chambers at the front face of said rear section.

2. The cylinder defined in claim 1 wherein said means includes a ball in said rear section and a spring in said rear section urging said ball against said stem.

3. The cylinder defined in claim 1 wherein said means includes a pin projecting from one of said sections toward the other section, said other section being formed with a recess, said pin receivable in said recess.

4. The cylinder defined in claim 1 wherein said means includes a spring carried in said rear section and engageable with said stem.

5. The cylinder defined in claim 4 wherein said rear section is formed with an inwardly opening groove and said stem with an outwardly opening notch, said spring being carried in said groove and being at least partially receivable in said notch.

* * * * *